US009999966B2

(12) United States Patent
Ballsieper et al.

(10) Patent No.: US 9,999,966 B2
(45) Date of Patent: Jun. 19, 2018

(54) TORQUE WRENCH

(71) Applicant: HAZET-WERK HERMANN ZERVER GMBH & CO. KG, Remscheid (DE)

(72) Inventors: Christian Ballsieper, Remscheid (DE); Patrick Klatt, Hagen (DE); Peter Welp, Wermelskirchen (DE)

(73) Assignee: HAZET-WERK HERMANN ZERVER GMBH & CO. KG, Remscheid (DE)

( * ) Notice: Subject to any disclaimer, the term of this patent is extended or adjusted under 35 U.S.C. 154(b) by 0 days. days.

(21) Appl. No.: 15/557,303

(22) PCT Filed: Feb. 17, 2016

(86) PCT No.: PCT/DE2016/100073

§ 371 (c)(1),
(2) Date: Sep. 11, 2017

(87) PCT Pub. No.: WO2016/141922

PCT Pub. Date: Sep. 15, 2016

(65) Prior Publication Data

US 2018/0050442 A1 Feb. 22, 2018

(30) Foreign Application Priority Data

Mar. 11, 2015 (DE) ..... 10 2015 103 539

(51) Int. Cl.
*B25B 23/142* (2006.01)
*B25G 3/12* (2006.01)

(52) U.S. Cl.
CPC ..... *B25B 23/1427* (2013.01); *B25G 3/12* (2013.01)

(58) Field of Classification Search
CPC ..... B25B 23/142; B25B 23/1427; B25G 3/12; B25G 3/16
See application file for complete search history.

(56) References Cited

FOREIGN PATENT DOCUMENTS

| | | |
|---|---|---|
| DE | 2006003274 | 6/2006 |
| DE | 202007008522 | 8/2007 |
| DE | 202007010665 | 12/2007 |
| DE | 202013100266 | 4/2014 |
| DE | 202013100268 | 5/2014 |
| WO | WO 2009/016471 | 2/2009 |

*Primary Examiner* — David B Thomas
(74) *Attorney, Agent, or Firm* — Jacobson Holman, PLLC.

(57) ABSTRACT

The invention relates to a torque wrench, which has a lever tube (3) having a handle (4) and has an indicating body (9) for indicating a set torque. The indicating body can be a scale housing or a scale sleeve. The handle (4) has a connecting piece (18), which points toward the indicating body (9) and which has a groove (19) on the outer periphery. Coupling segments directed toward the connecting piece (18) and having an abutment edge are provided on the indicating body (9). The handle (4) and the indicating body (9) are coupled by means of a locking ring (16). The locking ring (16) has blocking bodies for this purpose, which interact with the groove (19) on the connecting piece (18) and the abutment edges of the coupling segments in a locking manner. The torque wrench according to the invention is distinguished by the modular handle system thereof and enables economical production by means of structurally identical series together with simple assembly processes.

17 Claims, 14 Drawing Sheets

TORQUE WRENCH

Figure 1:
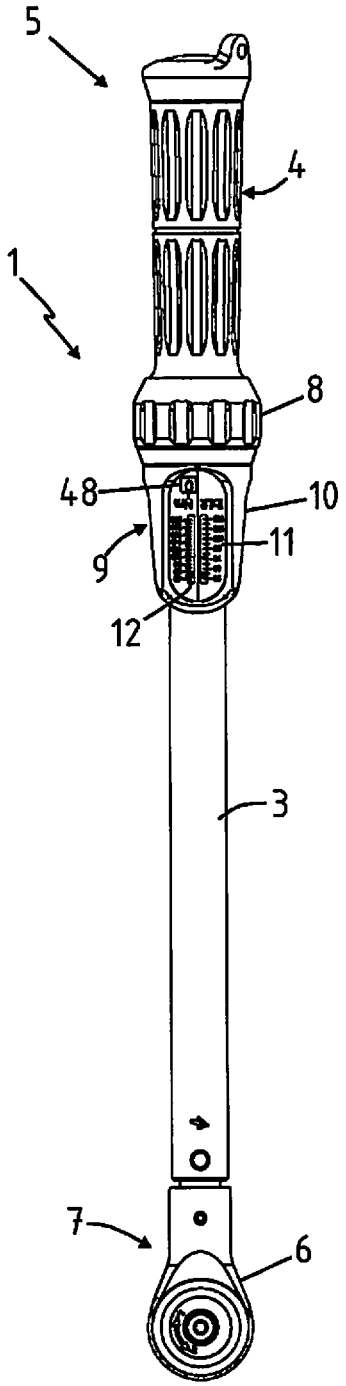

The invention pertains to a torque wrench in accordance with the features in the generic concept of Claim 1.

A torque wrench is a general term for a hand-operated screwdriver on which a specified tightening torque can be applied on a connection element such as a screw or bolt in order to ensure the production of the required clamping force between the components to be connected. DIN EN ISO 6789 distinguishes indicative torque wrenches (measuring wrenches) from the activating types (click or knack wrenches).

The most common embodiments of torque wrenches consist essentially of a lever tube whose length is adjusted to the torque range to be covered with a trigger mechanism accommodated in the lever tube such as a handle grip in the rear end and a drive part and/or toolhead at the front end. An adjusting device is connected to an indicator via the handle. The toolhead is often designed as a switchable or adjustable rod (also referred to as a ratchet).

The desired torque is set by compressing a pressure spring through which a handle connected to a thread spindle (and relative to the lever tube) is rotated. In order to secure the respective torques against adjustments when a torque wrench is being used, the handle will be set in an operating position on the lever tube. The set torque can be read on an indicator within the indicating body. The indicator is mostly designed as a scale with vernier in normal torque wrenches of today. The indicating bodies can be designed as scale sleeves or scale houses. DE 20 2013 100 266 U1 and DE 20 2007 008 522 U1 reveal indicating bodies in the form of scale sleeves. A torque wrench with an indicating body designed as a scale house is produced by DE 20 2013 100 268 U1.

DE 20 2006 003 274 U1 describes a torque wrench with a tubular shaft for which a handle grip is envisaged (relatively twistable and longitudinally adjustable at the end). The external surface of the shaft is equipped with a handle grip in the longitudinal area, in which at least one of the handle grips can be depressed on the locking elements fixed in the shaft. This locking element is made from a cylindrical roller whose longitudinal axis is extending in a manner parallel to the longitudinal axis of the shaft with one of its slit-shaped cut-outs (adjusted to the handle grip) located in the handle and capable of being brought forward to serve as a cover by rotating one of the locking sleeves arranged on the handle grip with a receiving recess within the inner surface of the locking sleeve.

DE 20 2007 010 665 U1 also reveals a torque wrench. In this regard, there is a receiving tool for receiving a screw or similar objects and an adapter element for receiving a handle grip being coupled together through a torque integration restriction tool. The torque restriction tool restricts the transfer of a maximum amount of torque from the adapter element to the receiving tool. The torque restriction tool is equipped with a shear pin for this purpose.

Based on the prior version, the objective of the invention is to produce a technically advantageous torque wrench as far as manufacturing and assembling are concerned.

According to the invention, this objective can be achieved in a torque wrench in accordance with Claim 1.

Advantageous forms and continued development of the fundamental inventive concept are the subject matters of dependent claims 2 to 17.

The modular handle system of the torque wrench is distinctive. The invention enables an economical production through structurally identical series and simpler mounting processes. Different torque wrench processes can be realized by exchanging indicating bodies.

A torque wrench according to the invention comprises a lever tube with a handle grip as well as an indicating body to indicate a set torque. An indicating body can be a scale sleeve or a scale house.

Such indicating bodies can be coupled with a handle grip. Thus, a structurally identical and/or uniform handle grip can be used for different embodiments of torque wrenches.

The handle grip and the indicating body are coupled together on the lever tube of the torque wrench. The handle grip has a connection piece pointing toward the indicating body. A groove is envisaged for the outer circumference of the connection piece. The indicating body possesses a coupling segment directed at the connection piece on which an abutment edge is envisaged. Coupling between the handle grip and the indicating body occurs via a locking ring. The locking ring has locking bodies which interact with the groove on the connection piece and the abutment edges of the coupling segments in a locking manner.

The fact that the locking ring is transportable in its locking position via rotation is an essential part of the invention.

The locking bodies comprise a pawl built on the spring limbs of the locking ring.

The locking body is geometrically configured in a way that it guarantees the locking function with the groove, on one hand, as well as the abutment edge on the other hand. Each abutment edge is built preferably on a locking groove positioned in a direction peripheral to a coupling segment. The width of the pawl is adjusted to the width of the groove in the connection piece of the handle grip as well as to the width of the locking groove in the coupling segments.

Furthermore, it is envisaged that a guiding element is designated on the locking body to interact with a control curve on the indicating body.

In a practically advantageous form, the guiding element is built as a cone or a cam with circular cross-sections protruding from the locking ring toward the indicating bodies and coming to bear on the control curve. The control curve is built in this form and/or in a control groove. The control curve is inserted in the front side of the indicating body pointing toward the locking ring. In particular, the control curve extends in a curved manner.

In one of the practically advantageous forms, each indicating body has two coupling segments and two control curves. Both coupling segments, on one hand, and both control curves, on the other hand, are preferably arranged on the indicating body, respectively arranged offset to one another by 180 degrees and designed inversely in the vertical and/or horizontal plane respectively.

The indicating body comprises a latching lug. A guiding groove is envisaged for the locking ring. The latching lug of the indicating body is engaged within the guiding groove.

In the guiding groove, a detent edge is built on which the latching lug comes to bear via its abutment edge in the locking position of the locking ring.

Advantageously, the detent edge is built on a latching lug envisaged to receive the latching lug in a locking position.

The coupling segments protrude from the indicating body toward the connection pieces of the handle grip. In order to mount the indicating body on the handle grip, the locking ring will first be attached on the indicating body and/or the coupling segment of the indicating body. There is a free space between the coupling segments to enable the attachment of the locking ring with radially inwards protruding locking bodies. During attachment, the guiding elements will be introduced to the front side of the indicating body's control groove envisaged on the locking bodies (responsible for forming the control curves). The blocking bodies and/or spring limbs of the locking rings (on which the pawls are built) are loosened in this position. The locking bodies protrude radially inwards within the inner space between the coupling segments. In this position the locking bodies are prevented from inserting the connection piece of the grip.

Subsequently, the locking ring is slightly rotated radially. In this regard, each guiding element moves along the control curve. The spring limb of the locking ring is radially moved outwards by this action. In this position the inner space of the indicating body is free for the passage of the connection piece. The connection piece of the grip can thus be inserted into the indicating body. The axial insertion movement of the grip is restricted through a touch on the grip piece of the handle. In this regard the handle piece comes to bear with a radially circulating shoulder section on the locking ring of the torque wrench. In a known manner the locking ring serves to release and/or lock the handle piece for the rotational movement in order to adjust a torque.

The locking ring will be further rotated following the insertion of the connection piece and its positioned locking ring into the indicating body. The rotational movement occurs radially in the same direction as before. The control curve in the indicating body is configured in a way that the spring limbs are decompressed and, once again, turned inwards radially. In this regard, the locking bodies of the locking rings are engaged in the groove on the connection piece and the locking bodies attain a locking position. In the locking position, the pawls of the locking bodies come to bear on the abutment edges of the coupling segments. An abutment edge is particularly built on a locking groove of the coupling segment as mentioned earlier.

During the rotation of the locking ring in a locking position, the latching lug of the indicating body moves in the guiding groove of the locking ring. A detent edge is built in the guiding groove on which a latching lug comes to bear via its abutment at the end of a rotational movement of the locking ring in a locking position. The latching lug is thus received in the locking pocket built in the locking ring. In this regard, the locking ring is locked from a reversal. The connection between a handle and an indicating body is axially and radially secured.

Locking position means the position of a handle, locking ring and indicating body as a function of (and/or based on the operating condition of) a torque wrench. The locking bodies and/or pawls are engaged in the groove of the connection piece. The latching lug is located in the locking pocket and bears against the detent edges.

In the event that the handle and the indicating body need to be dismantled (for example, in cases involving repairs and maintenance), the locking ring has an opening in its wall within the locking pocket area. With the aid of a tool driven through the opening, the locking pocket can be pressed inwards. In this manner the locking ring between the latching lug and detent edges will be released so that the locking ring can be reversed against the closing movement in the other direction. Dismantling of the individual components is possible in the open position.

In a version of the torque wrench according to the invention, the locking ring has a spring tab with a locking cam protruding toward the indicating body. The indicating body has a guiding groove with an inclined in-built extending guideway. A latching recess is envisaged at the end of the guideway. Mounting and connecting the handle and indicating body via the locking ring occur as described earlier by means of a locking body which interacts in a locking manner within the groove in the connection piece of the handle as well as the abutment edges of the coupling segments. In this version, setting the components in a locking position relative to one another occurs through the locking cam, which in the locking position of the locking ring, is engaged in the detent recess via the abutments.

Mounting of the components occurs as described previously. The connection piece is inserted in the indicating body with the locking ring positioned on it. Setting occurs via radial rotation of the locking ring around the longitudinal axis. During mounting, the locking ring and indicating body come to bear at the frontal side. In this regard, the locking cam protruding toward the indicating body is engaged in the guiding groove. During rotation of the locking ring, the locking cam will be relocated via the inclined plane or the guideway. The locking cam will be deflected backwards and/or upwards toward the indicating body's side of the locking ring directed away from the indicating body until the locking cam latches onto the latching recess resiliently at the end of the mounting movement and at the end of the guideway. The locking cam is engaged in the locking position of the locking ring of the detent recess via its abutment.

In particular, the locking cam is arranged at the free end of the spring tab.

The locking ring has a cut-out on the side of the spring tab opposite the locking cam. The cut-out ensures an appropriate free space for the deflection of the spring tab during mounting so that the locking cam and/or spring tab can be deflected elastically during the movement of the locking cam on the guideway.

This embodiment comes with the advantage that no elastic elements are needed on the indicating body in order to ensure the coupling of the components in a locking position. As a result, the indicating body can be designed along with usual materials such as metals or plastic, including more brittle materials as well such as ceramic, polymer concrete or fiber-reinforced material.

After mounting the components (as the functioning of the torque is being separated), the locking ring is prevented from further rotation by the locking cam located in the latching recess via its abutment. The connection between the handle and indicating body is thus axially and radially secured. In order to be capable of removing this security, the indicating body has an opening in the latching recess area of its outer wall. An appropriate tool can be driven through the opening to raise the locking cam and to move the latching recess from the latching position. This is to cause a reversal of the locking ring against the mounting and/or locking movement. Subsequently, it will be possible to dismantle the components.

In the locking position, the locking body of the locking ring produces a stable and positive connection between the handle and the indicating body. In the locking position, the locking bodies are unloaded and reliably cause axial locking between the handle and the indicating body. This is advantageous in the context of both the durability and the reliability of the connection in the event of a bad impact, for example, during an improper handling of the torque wrench such as an abrupt strain from a collapse.

As mentioned earlier, an indicating body can be a scale house or a scale sleeve.

With regard to a torque wrench in the form of a scale sleeve, the scale sleeve moves when the torque wrench is set via a rotational movement of the handle grip along with the grip. The mechanical coupling between the grip and the scale sleeve thus occurs via toothing, particularly a spur toothing. For this purpose, toothing elements are envisaged at the free end of the connection pieces for engagement with the driver element of the scale sleeve.

With regard to an indicating body in the form of a scale house, there is no radial rotation of the scale house. The grip and the scale house are coupled in a way that the scale house does not rotate axially during the rotational movement as the grip is being moved in advance or subsequently and does not rotate radially. Indication of the set torque occurs via a pointer firmly connected to the lever tube and a guide that secures the scale house. The scale house moves axially toward the pointer during adjustments. Each set torque will be displayed in a scale window of the scale house. Fine-tuning occurs via an additional vernier.

Due to the fact that no radial rotation of the scale house occurs around the lever tube, the scale house and the grip (and/or connection piece of the grip) are synchronized in a way that the scale house shifts axially when the torques are adjusted (however not rotated in a peripheral direction). Carrier elements engaged with the tooth elements of the connection piece are not needed in the scale house.

The grip, indicating body and locking ring can be made from plastic. The above-mentioned components can also be designed from metal. In addition, a combination of plastic and metal is possible for the design of the components. Furthermore, the individual components can be built from different materials or from hybrid components. The grip, for example, can be designed from a combination of metal and plastic.

The invention is described below in more detail through embodiment samples presented in the drawing illustrating the following:

FIG. 1 A torque wrench with an indicating body in the form of a scale house.

Figure 2:
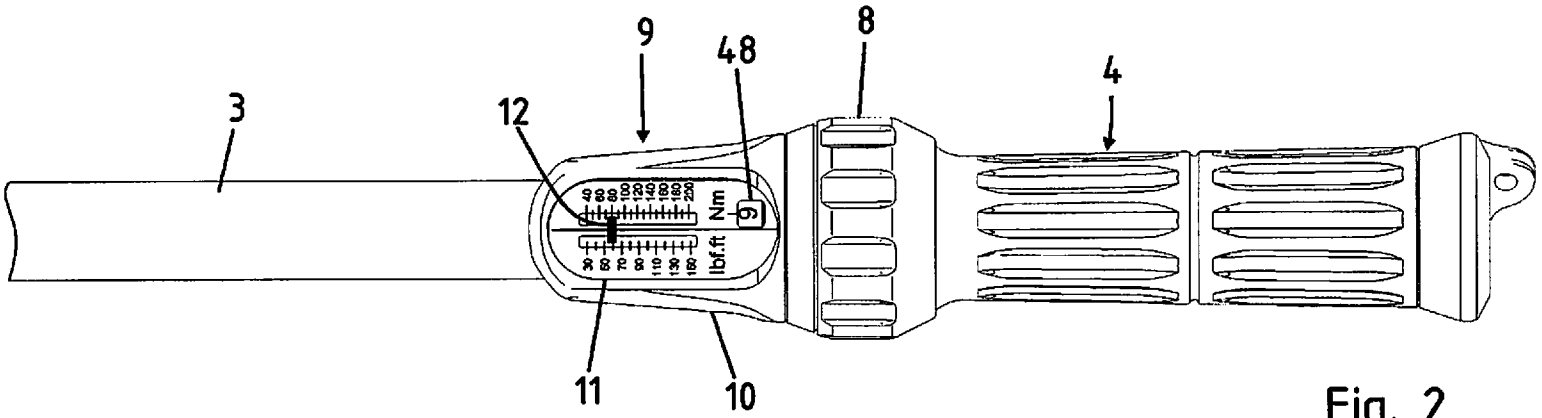

FIG. 2 The grip area of the torque wrench in accordance with FIG. 1 in an enlarged presentation.

Figure 3:
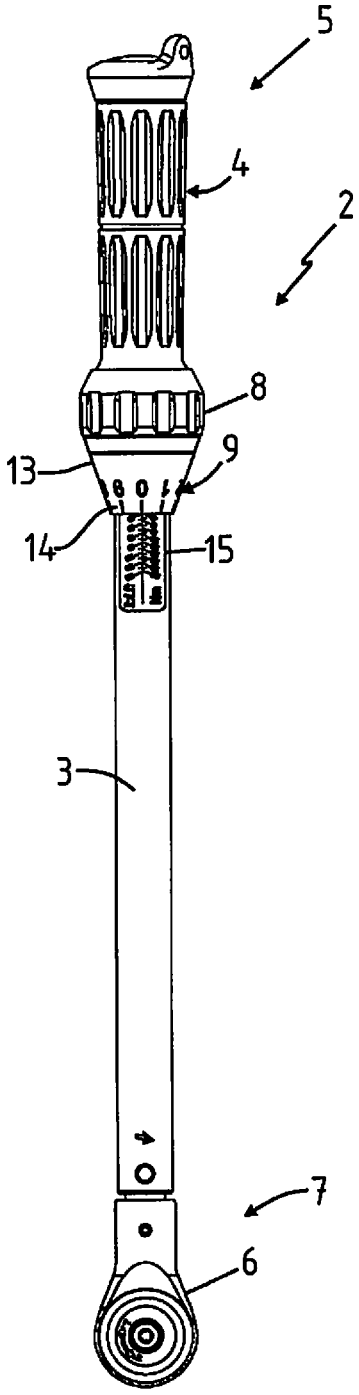

FIG. 3 A torque wrench with an indicating body in the form of a scale sleeve.

Figure 4:
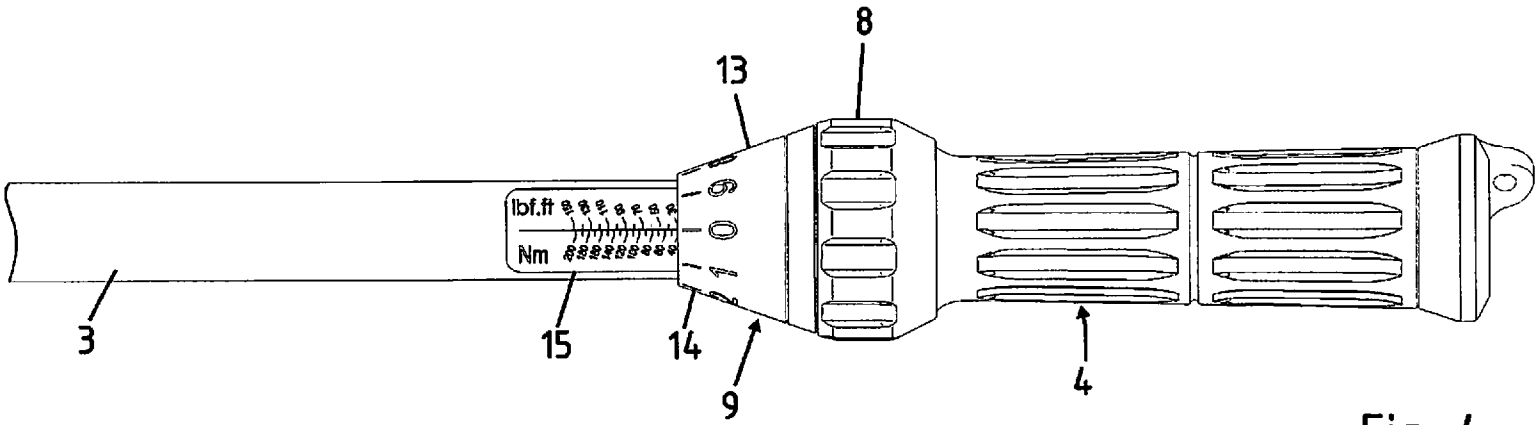

FIG. 4 A grip area of the torque wrench in accordance with FIG. 3 in an enlarged presentation.

Figure 5:
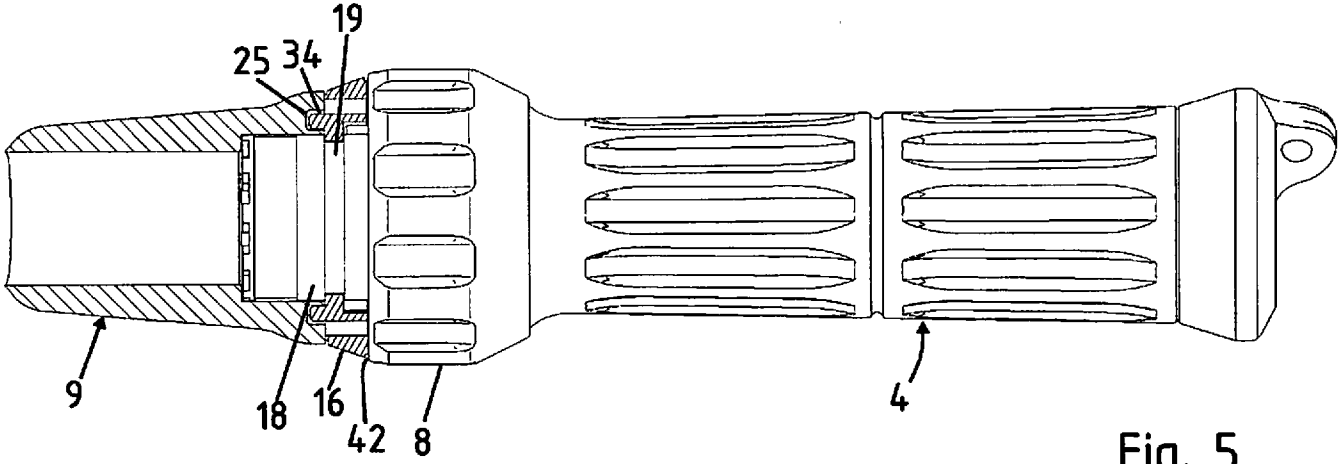

FIG. 5 A view, partially within a vertical profile, of the grip area of the torque wrench in accordance with FIG. 1.

Figure 6:
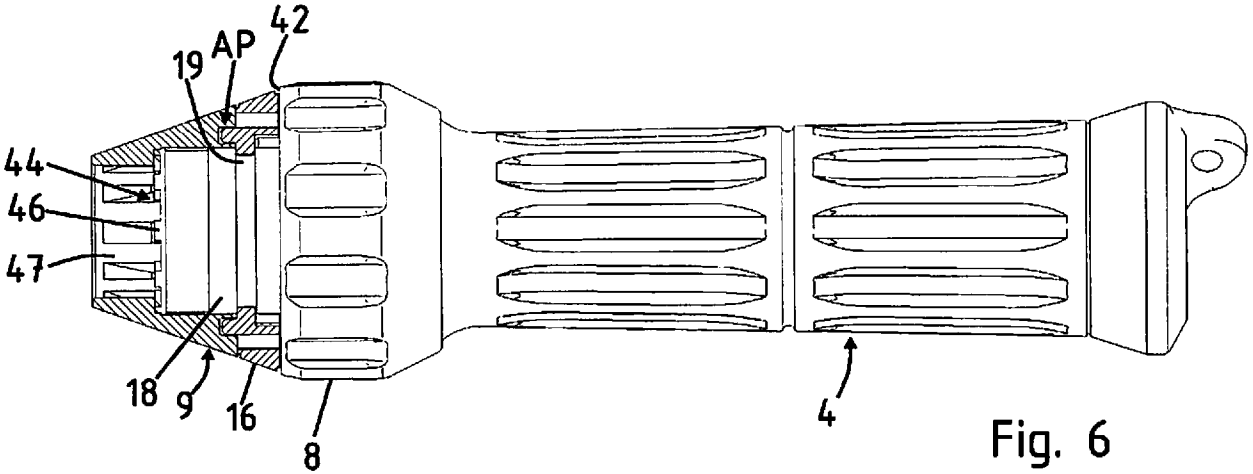

FIG. 6 A view, partially within a vertical profile, of the grip area of the torque wrench in accordance with FIG. 3.

Figure 7:
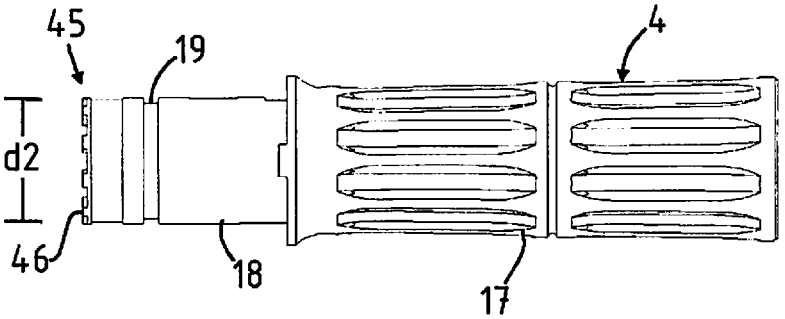

FIG. 7 A grip in a side view.

Figure 8:
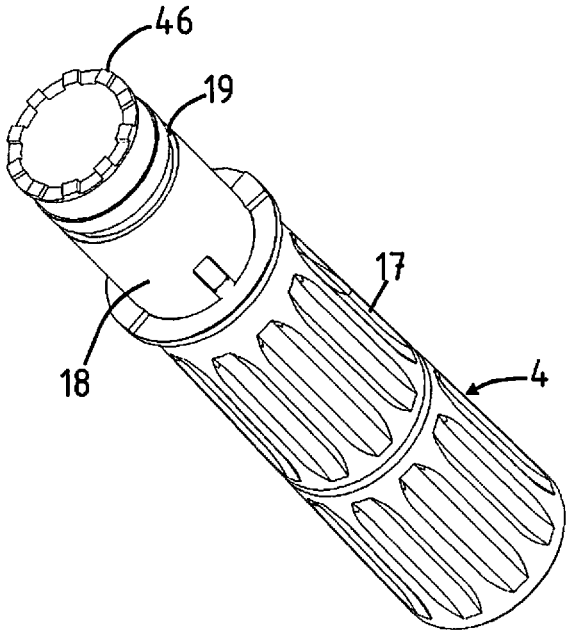

FIG. 8 A grip in a perspective view.

Figure 9:
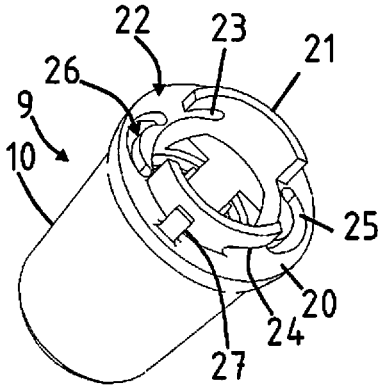

FIG. 9 An indicating body in the form of a scale house in a perspective presentation format.

Figure 10:
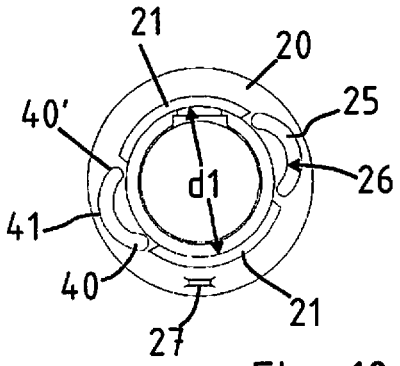

FIG. 10 A frontal view of the grip side at the end of the indicating body in accordance with FIG. 9.

Figure 11:
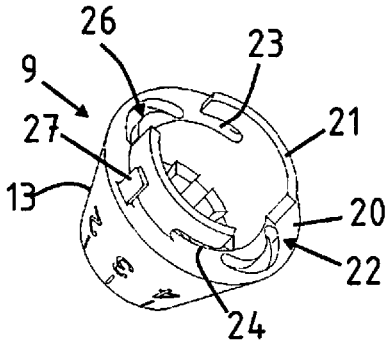

FIG. 11 An indicating body in the form of a scale sleeve in a perspective presentation format.

Figure 12:
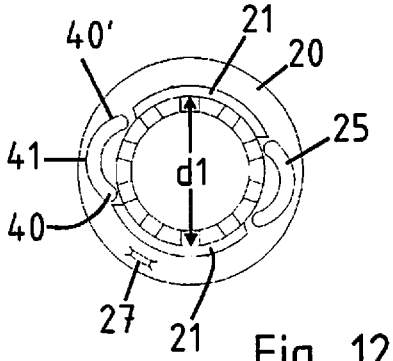

FIG. 12 A frontal view of the grip side of the indicating body according to FIG. 11.

Figure 13:
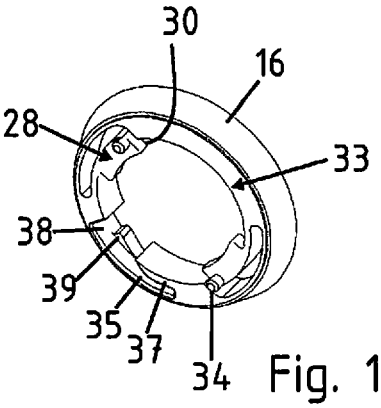

FIG. 13 A locking ring in a perspective presentation.

Figure 14:
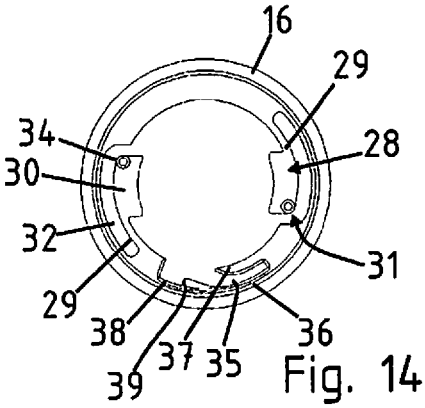

FIG. 14 A frontal view of the presentation of FIG. 13.

Figure 15:
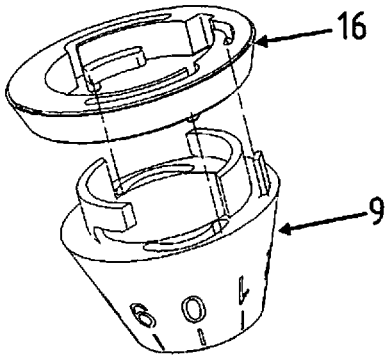

FIG. 15 The perspective of a scale sleeve and a locking ring prior to assembling.

Figure 16:
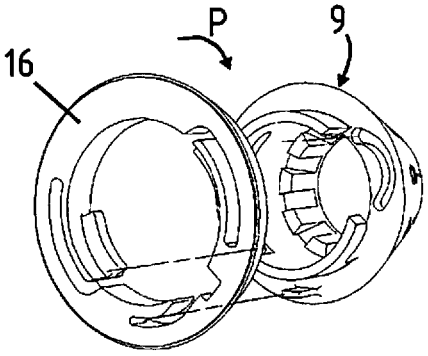

FIG. 16 The presentation corresponding to FIG. 15 from another perspective presentation.

Figure 17:
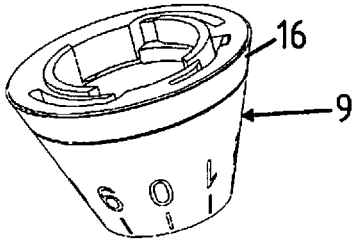

FIG. 17 The indicating body and the locking ring in a combined position.

Figure 18:
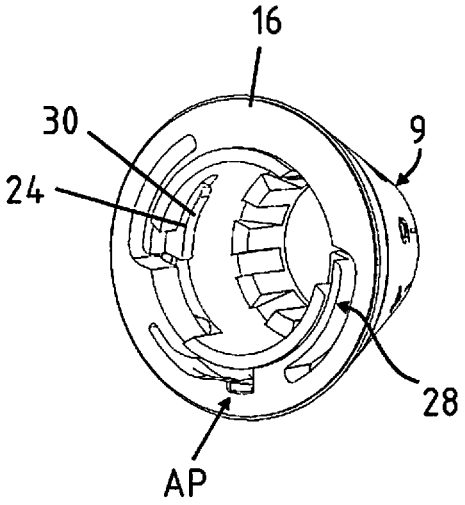

FIG. 18 A presentation corresponding to FIG. 17 in an oblique view from the rear.

Figure 19:
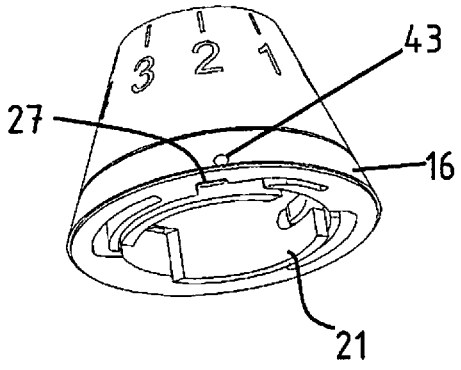

FIG. 19 The presentation corresponding to FIG. 18 with an oblique view of the indicating bodies and the sides.

Figure 20:
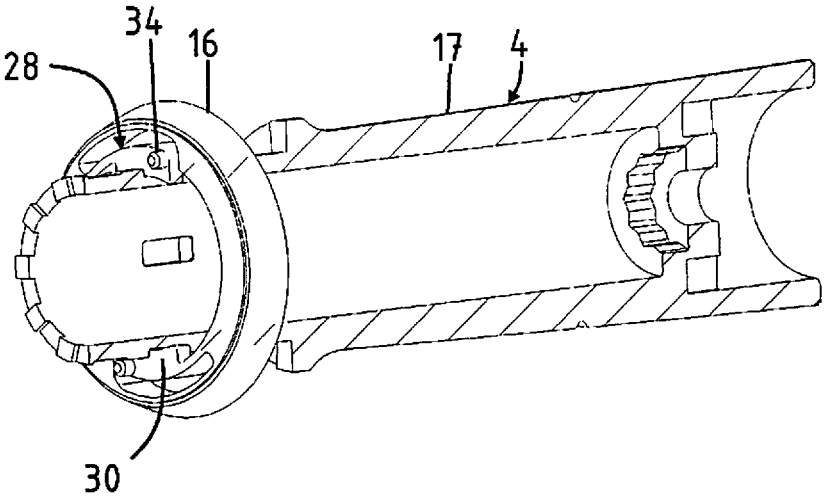

FIG. 20 A view, partially within a vertical profile, of the presentation of the grip with a locking ring positioned on the connection piece.

Figure 21:
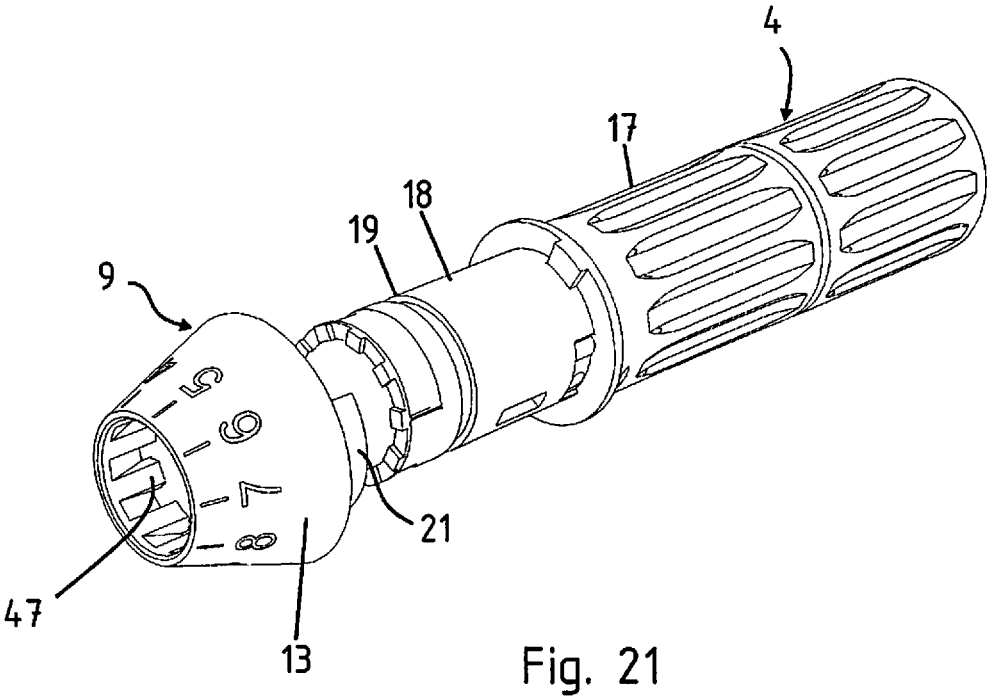

FIG. 21 A prospective presentation of the handle grip and an indicating body in the form of a scale sleeve prior to mounting without the presentation of a locking ring.

Figure 22A:
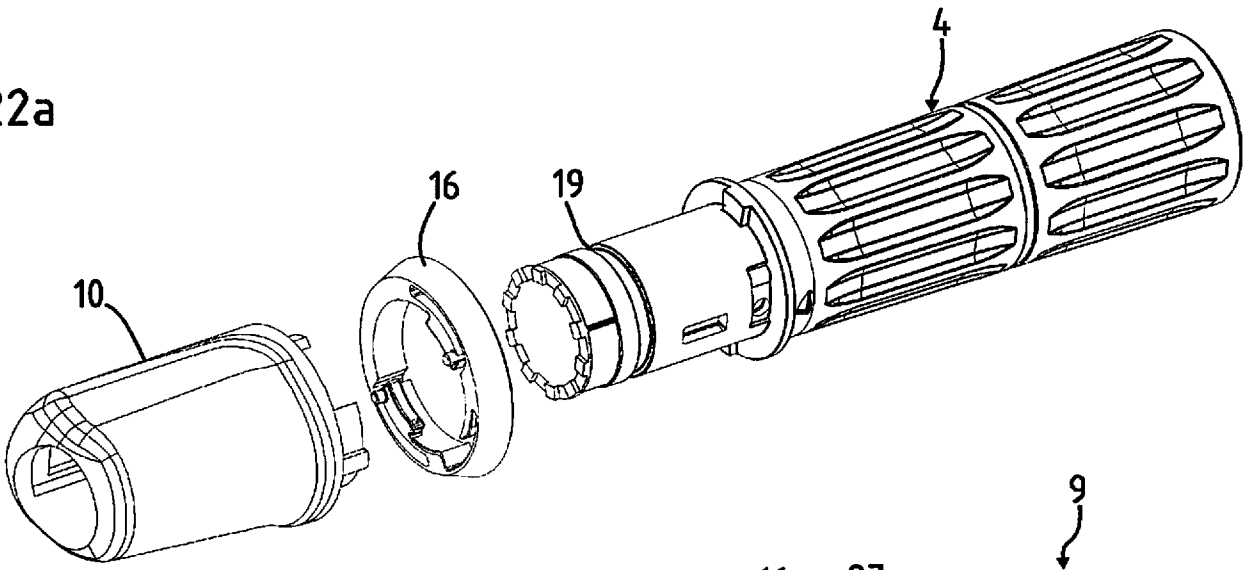
Figure 22B:
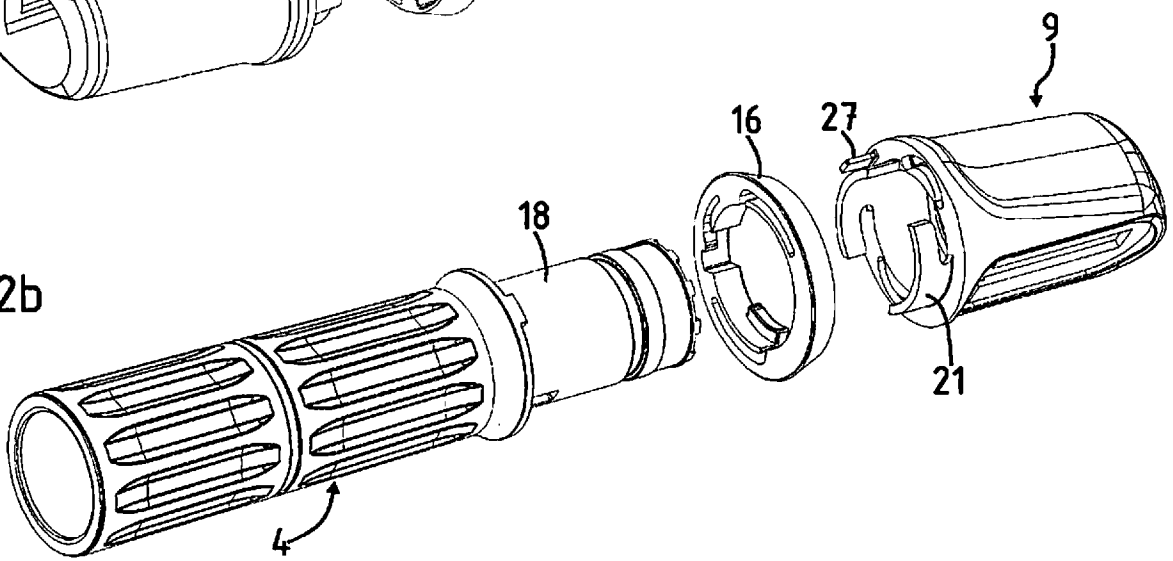

FIGS. 22*a* and *b* The torque wrench with an indicating body in the form of a scale house in two distinct prospective views.

Figure 23A:
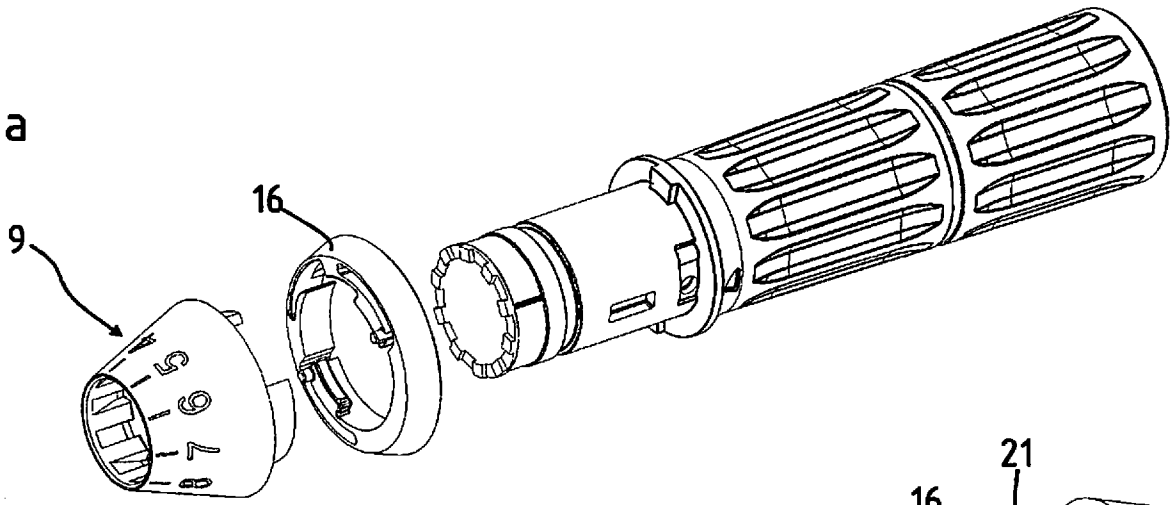
Figure 23B:
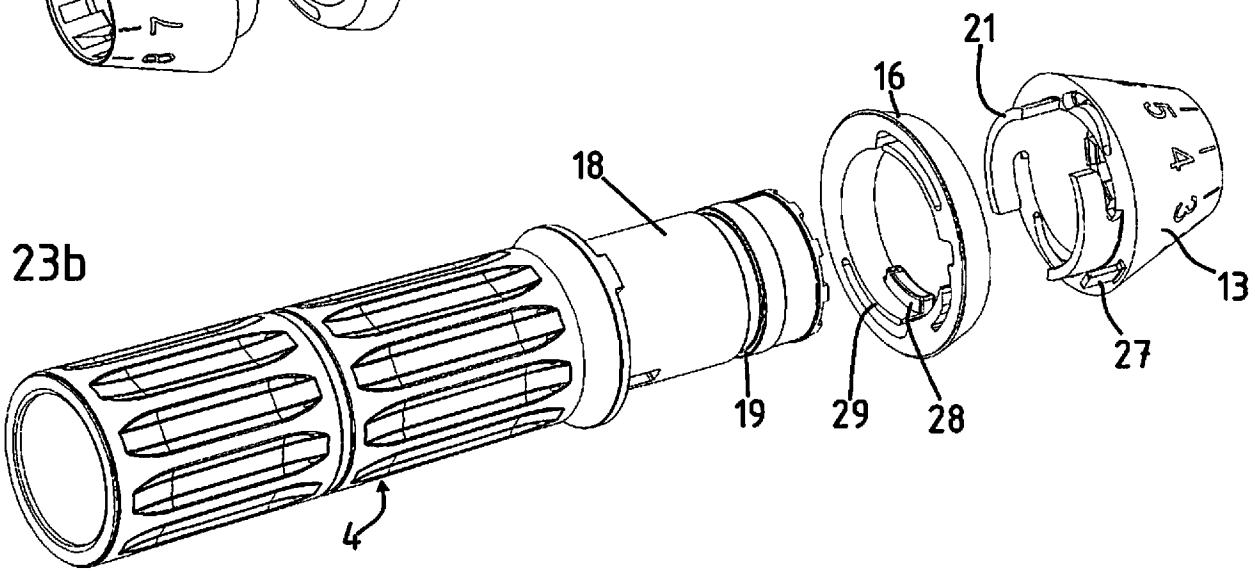

FIGS. 23*a* and *b* The torque wrench with an indicating body in the form of a scale sleeve in two distinct perspective views.

FIG. 24*a* to *h* The locking ring and indicating body in the form of a scale sleeve of an additional embodiment of a torque wrench in distinct views.

Figure 25A:
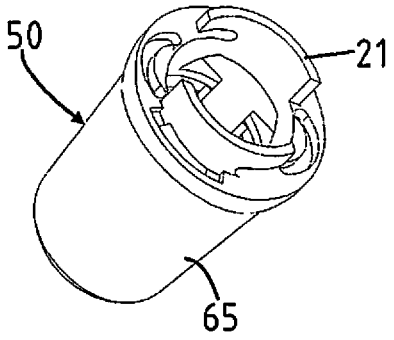
Figure 25B:
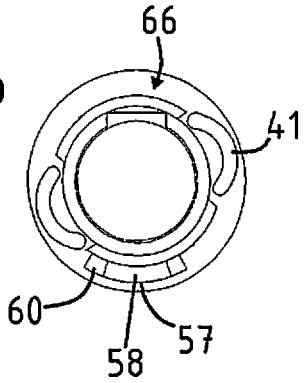

FIGS. 25*a* and *b* A perspective and frontal view of an indicating body in the form of a scale house.

Figure 26A:
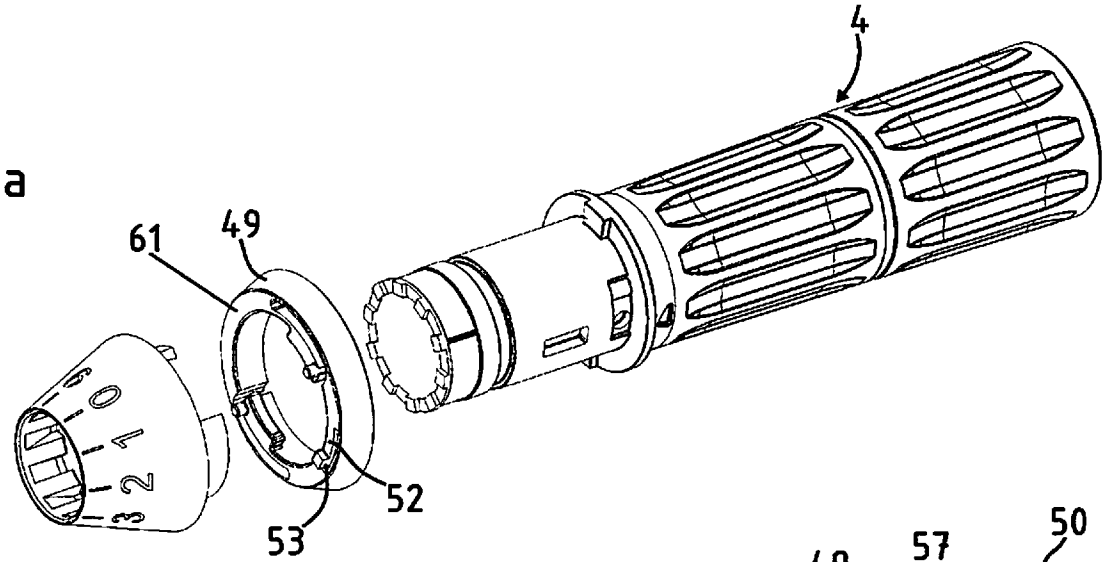
Figure 26B:
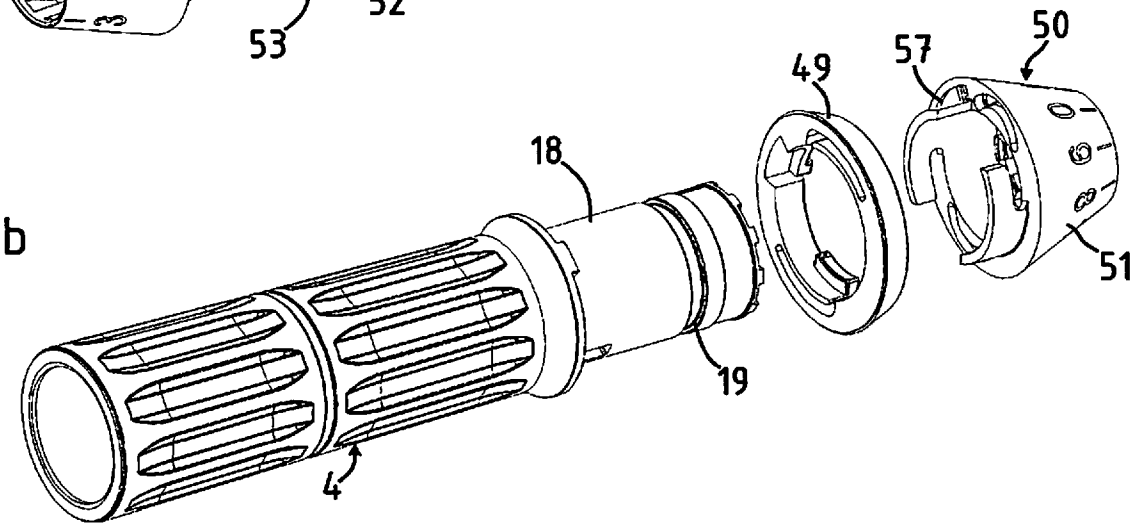
Figure 27A:
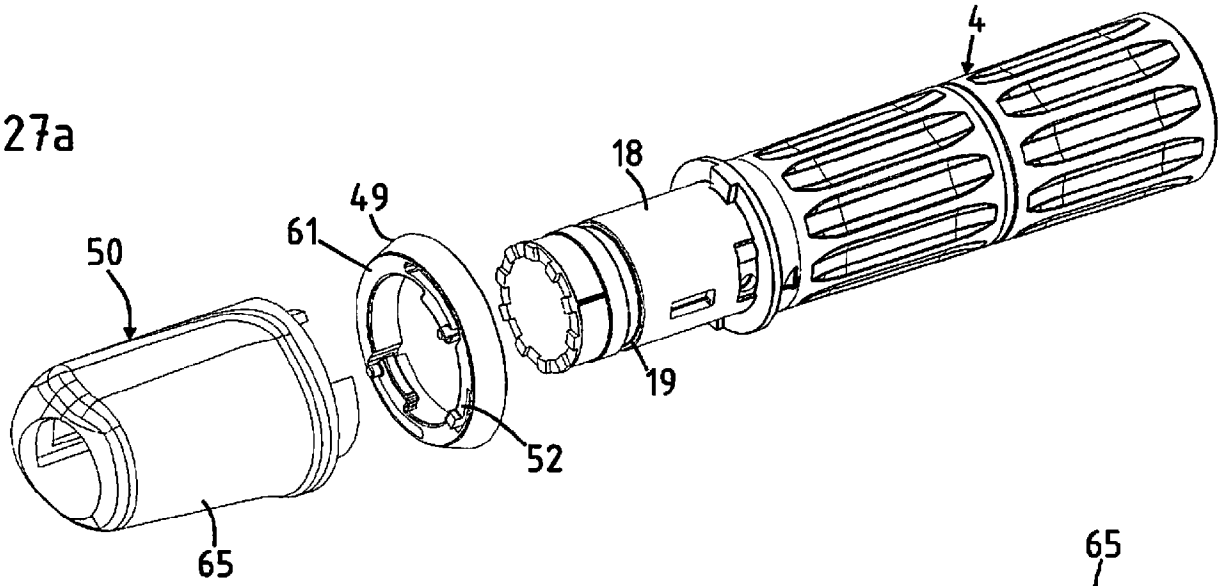
Figure 27B:
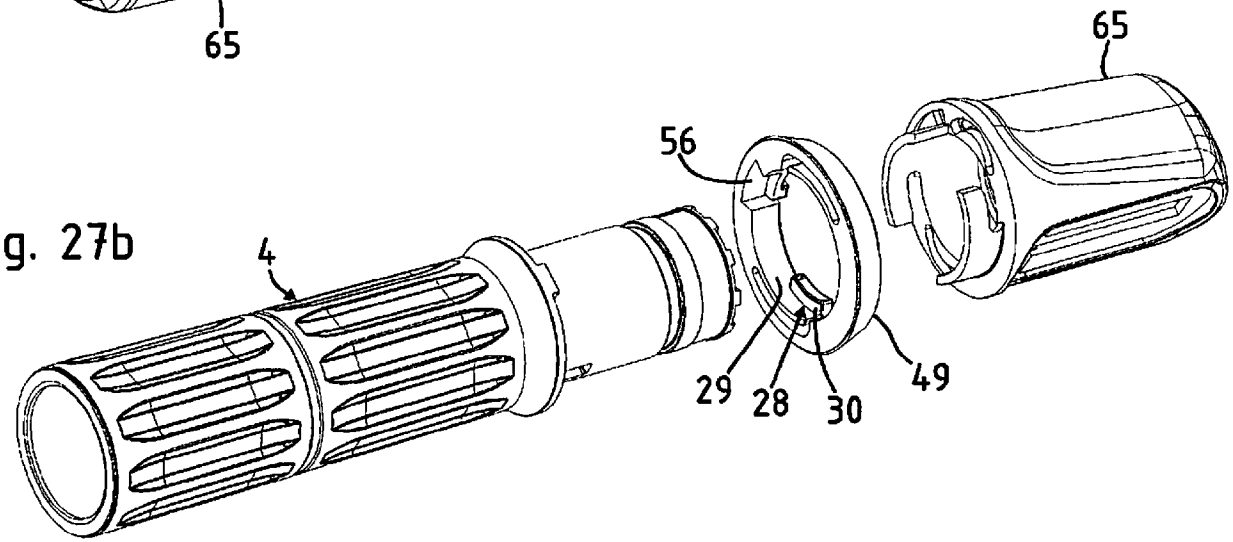

FIGS. 26*a* and *b* A torque wrench with an indicating body in the form of a scale sleeve corresponding to the presentation of FIG. 24 in two perspective views and FIGS. 27*a* and *b* An appropriately adapted torque wrench with an indicating body in the form of a scale house in two perspective view.

Correlating components and construction components are equipped with similar reference signs in the drawings.

FIGS. 1 and 3 show torque wrench 1 and 2, respectively, comprising lever tube 3 with grip 4 on rear end 5 and toolhead 6 on frontal end 7.

An adjustment mechanism (not presented here) is envisaged in lever tube 3. Adjustment occurs via rotation of grip 4. For this purpose grip 4 can be unlocked and/or interlocked. This is done via locking ring 8 which can be brought to a releasing and/or locking position via a rotational movement. In order to secure the set torques against maladjustments during the use of torque wrench 1 and 2, grip 4 will be set into operating position on the lever tube 3 via locking ring 8.

The set torque can be read on an indicator within the indicating body 9. Indicating body 9 is designed as a scale house 10 with a scale window 11 in torque wrench 1. Indication of the torque occurs via a pointer 12 and a vernier 48. Grip 4 is moved during a rotational movement and/or torque adjustment. In this regard, grip 4 goes along with scale house 10 in an axial direction (not, however, in a radial direction and/or peripheral direction toward lever tube 3).

Indicating body 9 is designed in the form of a scale sleeve 13 in Torque Wrench 2. Scale sleeve 13 carries a vernier 14. Lever tube 3 is equipped with a scale 15. Scale sleeve 13 is rotated simultaneously and, at the same time, shifted toward lever tube 3 during the rotation movement of grip 4 in order to adjust the torque.

FIGS. 2 and 4 show an enlarged section of the grip area of torque wrench 1 and/or 2. FIGS. 5 and 6 also show grip 4 with locking ring 8 as well as indicating body 9 mounted on grip 4. Setting (and/or connecting grip 4 and indicating body 9) occurs via a locking ring 16.

Once again, grip 4 is presented individually in FIGS. 7 and 8.

FIGS. 9 to 19 show an indicating body 9 in the form of a scale house 10 and an indicating body 9 in the form of scale sleeve 13 as well as locking ring 16 in distinct partial presentations and/or mounting positions.

FIG. 20 shows a locking ring 16 positioned on a grip 4 whereas FIG. 21 shows an indicating body 9 in the form of scale sleeve 13 in its position relative to grip 4 prior to mounting. Locking ring 16 is not presented here.

Grip 4 has a handle piece 17 as well as a connection piece 18 directed toward indicating body 9. The inner diameter of connection piece 18 is adjusted on the outer diameter of lever tube 3. A locking ring 8 is also positioned on connection piece 18. A radially circulating groove 19 is envisaged in the outer circumference of connection piece 18.

Indicating body 9 has coupling segments 21 protruding from two of its internal frontal sides 20 respectively toward connection pieces 18. The coupling segments 21 are configured in a cross section shape and are staggered to one another within a scope of 180 degrees. An open free space 22 is located between coupling segments 21. Inner diameter d1 between coupling segments 21 is adjusted on outer diameter d2 and/or on the outer circumference of connection piece 18. Coupling segments 21 comprise a locking groove 23 directed respectively in the peripheral direction of coupling segments 21. Locking groove 23 extends approximately by over a third of the peripheral length of coupling segment 21 during the transition of indicating body 9 to frontal side 20. The locking grooves 23 form an undercut with abutment edge 24.

Furthermore, two arched (curvy extending) control grooves 25 are envisaged in frontal side 20 of indicating body 9. Each control groove 25 forms a control curve 26 on indicating body 9. Both control grooves 25 are envisaged on indicating body 9 in free space area 22 between coupling segments 21 and are also staggered to one another by 180 degrees.

Furthermore, latching lug 27 axially protruding toward locking ring 16 and connection piece 18 is envisaged in indicating body 9.

Locking ring 16 is used as a link between grip 4 and indicating body 9. Locking ring 16 comprises locking bodies 28 which interacts in a locking position with connection piece 18 as well as abutment edges 24 of coupling segments 21.

Locking ring 16 has two spring limbs 29. Spring limbs 29 are circular-arc-shaped and are pointed toward the peripheral direction of locking ring 16. Locking bodies 28 have pawl 30 with a spring limb 29 arranged on the free-end area 31. Concentrically located at the back side of spring limb 29, cut-outs 32 (moving radially) enable a radially elastic flexibility of spring limb 29.

On side 33 of locking ring 16 facing indicating body 9, guiding elements 34 in the form of a cone are envisaged in free end 31 of spring limb 29. This is intended for engagement and interaction with control groove 25 and control curve 26.

Furthermore, a guiding groove 35 is envisaged in locking ring 16. Guiding groove 35 extends circumferentially toward locking ring 16 between outer wall 36 and locking ring 16 and an internally arcuate extending supporting wall 37. In the locking process guiding groove 35 interacts with latching lug 27 of indicating body 9. A latching lug 38 is built with a detent edge 39 in guiding groove 35. Locking pocket 38 is designated to receive latching lug 27 in the AP locking position of locking ring 16. Latching lug 27 comes to bear via its abutments in an AP locking position of detent edge 39 of locking pocket 38.

In the process of mounting to connect grip 4 and indicating body 9, lock ring 16 will be inserted into coupling segment 21 of indicating body 9. This fact is clarified by the presentation of FIGS. 15 to 17. Spring limb 29 protrudes in free space area 22 between coupling segments 21. Coupling segments 21 (with its outer periphery) lay within the inner peripheral wall of locking ring 16. Spring limbs 29 are unloaded. Guiding element 34 are engaged in control groove 25.

By means of a rotation movement in the image plane according to Arrow P, guiding elements 34 slide along control curve 25 built in control groove 26. Control curve 26 rises outwards towards center 41 from internally located end 40. By virtue of this particular movement spring limb 29 and the locking bodies 28 of spring limb 29 will be moved radially outwards. In this regard, the inner space between the coupling segments 21 will be released. Locking body 28 will no longer protrude inwards toward the inner diameter of coupling segments 21. In this position connection pieces 18 can be shifted axially to coupling segments 21 and indicating body 9 until locking ring 8 come to bear with its circumferential annular shoulder 42 on locking ring 16. The length of connection pieces 18 and the position of groove 19 on the outer periphery of connection pieces 18 is adjusted in a way that groove 19 is congruently positioned with locking body 28 of locking ring 16.

Latching lug 27 lays in this position in front of locking pocket 38.

Locking ring 16 is further rotated in a circumferential manner. Guiding elements 34 move downwards each time in control groove 25 internally until the other end 40 of control curve 26. Thus, spring limbs 29 are loosened and move radially inwards. As a result pawls 30 are engaged in groove 19. Spring limbs 29 lay loosened in the outer periphery of coupling segment 21. Pawl 30 are introduced to the locking groove 23 and lay on the abutment edge 24.

Locking ring 16 is also further rotated relative to latching lug 27 during the rotational movement. As a result, latching lug 27 moves to locking pocket 38. Latching lug 27 comes to bear in the detent edge 39 of locking pocket 38 via its abutments. Thus, an automatic and/or unintended reversal of the locking ring 16 in an open position is not possible.

Grip 4 and indicating body 9 are firmly connected through locking ring 16. In the AP locking position, locking bodies 28 interact in a locking manner with groove 19 on connection piece 18 as well as on abutment edge 24 of coupling segment 21. Pawl 30 are engaged in groove 19. Latching lug 27 comes to bear at detent edge 39 of locking pocket 38 via its abutments.

In order to enable an opening in locking ring 16, an opening 43 is envisaged in the outer wall 36 of locking ring 16 at the area of locking pocket 38. A tool can be inserted in this opening 43 and latching lug 27 can be pressed radially inwards in order to release the abutment position of locking pocket 38. Locking ring 16 can therefore be rotated in the opposite direction to enable dismantling.

With regard to indicating body 9 in the form of scale sleeve 13, grip 4 and scale sleeve 13 are coupled in an axial and radial direction by spur tooth 44. Thus, tooth elements 46 are envisaged in free end 45 of connection piece 18. Tooth elements 46 are envisaged in mounting position with driver elements 47 of scale sleeve 13. As a result, scale sleeve 13 will be rotated during the rotation of grip 4 to adjust a torque toward lever tube 3.

Tooth elements 46 have no role in free end 45 regarding the embodiment of indicating body 9 as a scale house 10 of connection piece 18.

Spring limbs 29 are unloaded in the AP locking position. Pawls 30 of locking body 28 are engaged in groove 19 at the outer periphery of connection piece 18. Simultaneously, pawls 30 are engaged in locking groove 23 behind abutment edge 24. Grip 4 and indicating body 9 as well as locking ring 16 are coupled and secured axially and radially in a locking position.

Once again FIGS. 22*a* and *b* (as well as FIGS. 23*a* and *b*) reveal the components essential to the invention of torque wrench 1 and/or 2 in an explosively perspective presentation of Grip 4 (separately concluded from one another) along with connection piece 18 and groove 19, including locking ring 16 and indicating body 9 in the form of a scale house 10 and/or a scale sleeve 13.

Figure 24A:
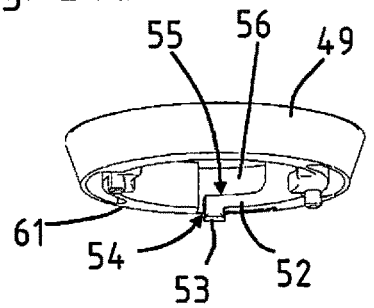
Figure 24B:
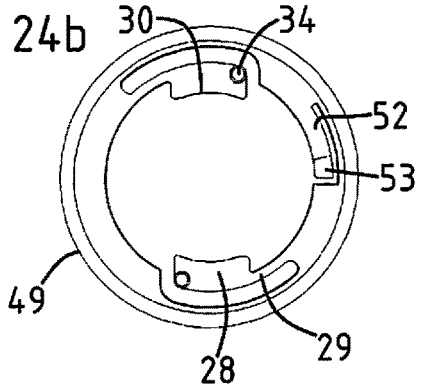
Figure 24C:
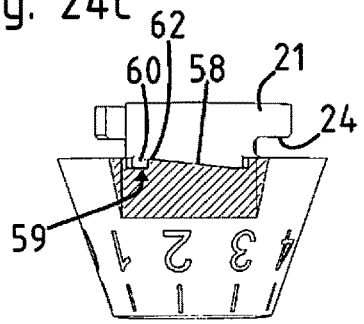
Figure 24D:
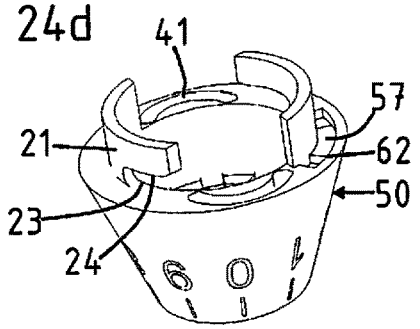
Figure 24E:
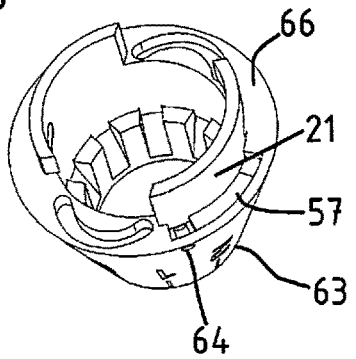
Figure 24F:
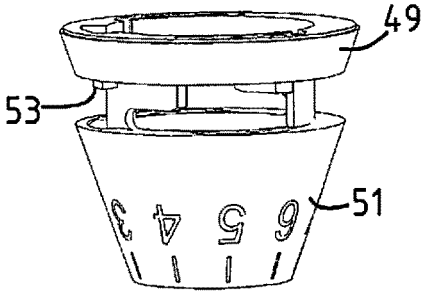
Figure 24G:
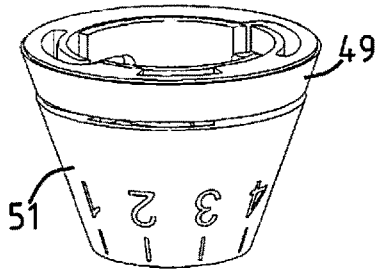
Figure 24H:
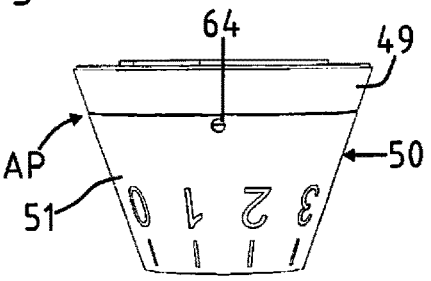

Based on FIG. 24*a* to *h* (as well as FIGS. 26*a* and *b*), an alternative embodiment of locking ring 49 and indicating body 50 in the form of a scale sleeve 51 is presented and explained. FIG. 24*c* reveals indicating body 50 in a partially cut presentation.

Coupling between grip 4 (via connection piece 18 and groove 19) occurs as described previously in order to be dispensed in a detailed reproduced explanation. Indicating body 50 comprises coupling segment 21 with abutment edges 24. Locking ring 49 comprises locking body 28 which interacts with groove 19 on connection piece 18 as well as abutment edge 24 of coupling segment 21 in a locking manner. Locking ring 49, as explained before, is transportable through a rotational movement in the AP locking position. Locking bodies 28 have pawls 30 built on spring limb 29 of locking ring 49.

Contrary to the version described before, locking ring 49 has a spring tab 52 with a locking cam 53 protruding toward indicating body 50. Locking cam 53 is arranged on free end 54 of spring tab 52. A cut-out 56 is envisaged on locking cam 53 opposite side 55 of spring tab 52. Indicating body 50 has a guiding groove 57 with an inclined extending guideway 58. A latching recess 60 is envisaged at the end 59 of guideway 58. Locking cam 53 comes to bear in the AP locking position of locking ring 49 via its abutment in latching recess 60 and/or is engaged in the said latching recess.

Mounting occurs in the manner described before. Locking ring 49 will be placed on coupling segments 21 of indicating body 50 and subsequently rotated, wherein spring limbs 29 and locking body 28 are first moved radially outwards. Grip 4 and connection piece 18 can be shifted through locking ring 49 within indicating body 50. Simultaneously, locking cam 53 will also be introduced to guiding groove 57 on front side 61 of locking ring 49. Once again, locking ring 49 will then be located in a circumferential manner. Spring limb 29 will be loosened and locking body 28 will be engaged in groove 19 on connection piece 18. Furthermore, locking body 28 is located in a locking position behind abutment edges 24 of coupling segment 21.

During rotational movements, locking cam 53 will be moved along guideway 58. This is from right to left in the image plane of FIG. 24*c*. Loading cam 53 is raised above the inclined plane of inclined extending guideway 58 during a rotational movement. Spring tab 52 will be deflected upwards in the image plane. Latching recess 60 is arranged at end 59 of guide way 58. Once locking cam 53 passes by detent edge 62 on the passage of guideway 58 toward latching recess 60, spring tab 52 bounces toward indicating body 50 and locking cam 53 is engaged in latching recess 60 via its abutment edges. An automatic or unintended turning back of locking ring 49 will be prevented through the locked locking cam 53. In order to make an opening in locking ring 49, an opening 64 is envisaged in the outer wall 63 of indicating body 50 within the area of latching recess 60. By means of a tool driven through opening 64, locking cam 53 can be released from its locking position in latching recess 60. Subsequently, locking ring 49 can then be rotated in the opposite direction in order to enable dismantling of the components.

Even when the version is described in accordance with FIG. 24 on the sample of indicating body 50 in the form of a scale house 51, indicating body 50 can also be designed as scale house 65. The presentations of FIGS. 25*a* and *b* reveal this fact. Even in this regard, indicating body 50 and/or scale house 65 have a guiding groove 57 (in its frontal side 66) with an inclined extending guideway 58 on whose end 59 a latching recess 60 is envisaged. Locking ring 49 is presented as in FIG. 24. Details can also be seen in FIGS. 27*a* and *b* revealing perspective views of grip 4 with connection pieces 18, locking ring 49 as well as scale house 65.

REFERENCE SIGNS

1.—Torque wrench
2.—Torque wrench
3.—Lever tube
4.—Handle
5.—Rear end
6.—Toolhead
7.—Frontal end
8.—Locking ring
9.—Indicating body
10.—Scale house
11.—Scale window
12.—Indicator
13.—Scale sleeve
14.—Vernier scale
15.—Scale
16.—Locking ring
17.—Handle piece
18.—Connection piece
19.—Groove
20.—Frontal side 9
21.—Coupling segment
22.—Free space
23.—Locking groove
24.—Abutment edge
25.—Control groove
26.—Control curve
27.—Latching lug
28.—Locking bodies
29.—Spring limbs
30.—Pawls
31.—Free-end 29
32.—Cut-out
33.—Side 16
34.—Guiding element
35.—Guiding groove
36.—Outer wall 16
37.—Supporting wall
38.—Locking pocket
39.—Detent edge
40.—End 26
40'.—Another end 26
41.—Center 26
42.—Annular shoulder
43.—Opening
44.—Spur tooth
45.—Free-end 18
46.—Tooth elements
47.—Driver element
48.—Vernier
49.—Locking ring

50.—Indicating body
51.—Scale sleeve
52.—Spring tab
53.—Locking cam
54.—Free end 52
55.—Side
56.—Cut-out
57.—Guiding groove
58.—Guideway
59.—End 58
60.—Latching recess
61.—Frontal side 49
62.—Detent edge
63.—Outer wall 50
64.—Opening
65.—Scale house
66.—Frontal side 50
d1—Inner diameter between 21
d2—outer diameter of 18
p—Arrow
AP—Locking Position

The invention claimed is:

1. A torque wrench comprising a lever tube (3) with a grip (4) and an indicating body (9, 50) for indicating a set torque characterized in that the grip (4) has a connection piece (18) facing the indicating bodies (9, 50) with a groove (19) on the outer diameter and on indication body (9, 50) for coupling segments (21) directed toward a connection piece (18) with an envisaged abutment edge (24) and the grip (4) and the indicating body (9, 50) are coupled through a locking ring (16, 49), wherein the locking ring (16, 49) comprises a locking body (28), which works with the groove (19) on the connection piece (18) as well as the abutment edges (24) of the coupling segments (21).

2. A torque wrench in accordance with claim 1 characterized in that the locking ring (16, 49) is transportable through a rotational movement in its locking position (AP).

3. Torque wrench in accordance with claim 1 characterized in that the locking body (28) includes pawls (30) built in a spring limb (29) of a locking ring (16, 49).

4. Torque wrench in accordance with claim 1, characterized in that the abutment edges (24) are built on the locking grooves (23) of the coupling segments (21).

5. Torque wrench in accordance with claim 1 characterized in that a guiding element (34) is envisaged on the locking body (28) which interacts with a control curve (26) on the indicating body (9, 50).

6. Torque wrench in accordance with claim 5, characterized in that the control curve (26) is built on an arc-formed extending control groove (25).

7. Torque wrench in accordance with claim 1, characterized in that the indicating body (9) comprises a latching lug (27) which is engaged in a guiding groove (35) in the locking ring (16).

8. Torque wrench in accordance with claim 7, characterized in that a detent edge (39) is built in the guiding groove (35) on which the latching lug (27) comes to bear via the abutments in the locking position (AP) of the locking ring (16).

9. Torque wrench in accordance with claim 8, characterized in that the detent edge (39) is built on a latching lug (38) which receives the latching lug (27).

10. Torque wrench in accordance with claim 9, characterized in that the outer wall (36) of the locking ring (16) has an opening (43) in the area of the locking pocket (38).

11. Torque wrench in accordance with claim 1, characterized in that the locking ring (49) has a spring tab (52) with a locking cam (53) protruding toward the indicating body (50) and the indicating body (50) has a guiding groove (57) with an inclined extending guide way (58), wherein a latching recess is envisaged at an end (59) of the guideway (58) and the locking cam (53) engaged in the latching recess (60) via its abutment edges in a locking position (AP) of the locking ring (49) in the latching recess (60).

12. Torque wrench in accordance with claim 11, characterized in that the locking cam (53) is arranged on the free-end (54) of the spring tab (52).

13. Torque wrench in accordance with claim 11, characterized in that the spring tab (52) has a cut-out (56) on the side (55) opposite the locking groove (53) of the locking ring (49).

14. Torque wrench in accordance with claim 11, characterized in that the indicating body (50) has an opening (64) in its outer wall (63) within the area of the latching recess (60).

15. Torque wrench in accordance with claim 1, characterized in that the indicating body (9, 50) is a scale house (10, 65).

16. Torque wrench in accordance with claim 1, characterized in that the indicating body (9, 50) is a scale sleeve (13, 51).

17. Torque wrench in accordance with claim 16, characterized in that tooth elements (46) are envisaged at the free-end (45) of the connection piece (18) which engage with the driver elements (47) of the scale sleeve (13, 51).

* * * * *